United States Patent [19]

Johnston et al.

[11] Patent Number: 5,068,811

[45] Date of Patent: Nov. 26, 1991

[54] ELECTRICAL CONTROL SYSTEM FOR ELECTROSTATIC PRECIPITATOR

[75] Inventors: David F. Johnston, Tabb, Va.; Terry L. Farmer, Pleasant Valley, Mo.

[73] Assignee: BHA Group, Inc., Kansas City, Mo.

[21] Appl. No.: 558,827

[22] Filed: Jul. 27, 1990

[51] Int. Cl.[5] ..... B03C 3/66

[52] U.S. Cl. ..... 364/551.01; 55/105; 323/241; 323/903

[58] Field of Search ..... 55/105, 106; 323/241, 323/903; 364/480, 551.01, 150

[56] References Cited

U.S. PATENT DOCUMENTS

| | | | |
|---|---|---|---|
| 3,873,282 | 3/1975 | Finch | 55/105 |
| 4,152,124 | 5/1979 | Davis | 55/105 |
| 4,290,003 | 9/1981 | Lanese | 55/105 X |
| 4,587,475 | 5/1986 | Finney, Jr. et al. | 323/241 |
| 4,605,424 | 8/1986 | Johnston | 55/105 X |
| 4,648,887 | 3/1987 | Noda et al. | 55/105 X |
| 4,860,149 | 8/1989 | Johnston | 55/105 X |
| 4,936,876 | 6/1990 | Reyes | 55/105 X |
| 4,996,471 | 2/1991 | Gallo | 323/241 |

*Primary Examiner*—Parshotam S. Lall
*Assistant Examiner*—Edward R. Cosimano
*Attorney, Agent, or Firm*—Kokjer, Kircher, Bowman & Johnson

[57] ABSTRACT

Form factor measurement and fault detection equipment to determine proper sizing of electrical components and efficiency of an electrostatic precipitator (22) by calculating a system form factor from either primary voltage or current. A power source (10) connects serially to an inverse parallel SCR1 and SCR2, to a current limiting reactor (16), and to a T/R set comprising a transformer (18) and rectifier (20) which supply power to precipitator (22). A current transformer (26) senses input current between the reactor (16) and T/R set (18,20) to signal an input scaling and signal conditioner (28) connected to a current meter (34), a voltage meter (39) and a computer (40) having a display monitor (42). The computer (40) is also connected to an SCR control circuit (24) of SCR1 and SCR2. The appropriate electrical characteristic is converted to both its RMS value and average value and then sent to the computer (40). The computer (40) divides the RMS value by the average value and sends the resulting form factor value to the display (42). If system form factor value is not sufficiently close to the purely resistive circuit value of 1.11, then equipment resizing is needed to increase system efficiency. Additionally, secondly electrical characteristics are used to calculate fractional conduction. If the fractional conduction is not sufficiently close to a desired level, equipment adjustments are made to increase system efficiency.

73 Claims, 4 Drawing Sheets

+15V
-15V
52
53
50
51
46
40
60
62
54
56
48
61
63
CURRENT TRANSFORMER
26
VOLTAGE TRANSFORMER
30
58
COMPUTER
VOLTAGE METER
39
64
65
28
+5V
34
CURRENT METER
32
37
41

ELECTRICAL CONTROL SYSTEM FOR ELECTROSTATIC PRECIPITATOR

BACKGROUND AND SUMMARY OF THE INVENTION

This invention relates generally to electrostatic precipitators for air pollution control and, more specifically, concerns the electrical control of electrostatic precipitators.

Continuous emphasis on environmental quality has resulted in increasingly strenuous regulatory controls on industrial emissions. One technique which has proven highly effective in controlling air pollution has been the removal of undesirable particulate matter from a gas stream by electrostatic precipitation. An electrostatic precipitator is an air pollution control device designed to electrically charge and collect particulates generated from industrial processes such as those occurring in cement plants, pulp and paper mills and utilities. Particulate laden gas flows through the precipitator where the particulate is negatively charged. These negatively charged particles are attracted to, and collected by, positively charged metal plates. The cleaned process gas may then be further processed or safely discharged to the atmosphere.

To maximize the particulate collection, a precipitator should be operated at the highest practical energy level to increase both the particle charge and collection capabilities of the system. Concurrently, there is a level above which "sparking" (i.e., a temporary short which creates a conductive gas path) occurs in the system. Left uncontrolled, this sparking can damage the precipitator and control system. The key to maximizing the efficiency of an electrostatic precipitator is to operate at the highest energy level possible.

Ideally, the electrostatic precipitator should constantly operate at its point of greatest efficiency. Unfortunately, the conditions, such as temperature, combustion rate, and the chemical composition of the particulate being collected, under which an electrostatic precipitator operates are constantly changing. This complicates the calculation of parameters critical to a precipitator's operation. This is particularly true of the current limiting reactor (CLR) which controls and limits the current entering the precipitator and matches the precipitator load to the line to allow for maximum power transfer to the precipitator.

The current limiting reactor (CLR) has two main functions. The first is to shape the voltage and current wave forms that appear in the precipitator for maximum collection efficiency. The second function of the CLR is to control and limit current.

Power control in a precipitator is achieved by silicon controlled rectifiers (SCRs). Two SCRs are connected in an inverse parallel arrangement in series between the power source and the precipitator high voltage transformer. The power source is an alternating current (AC) sinusoidal wave form whose value is zero at the beginning and end of every half cycle, and is a positive value during one half cycle and a negative value during the next half cycle. For a power source with a 60 Hz. frequency, this would occur every 8.33 milliseconds. (10 milliseconds for a 50 Hz. power source). Only one SCR conducts at a time on alternate half cycles. The automatic voltage control provides gating such that the appropriate SCR may be switched on at the same point during the half cycle to provide power control. The SCR remains switched on or in conduction until the current passing through the SCR falls below a specified value for the device. The cycle is then repeated for the next half cycle and the opposite SCR. The SCRs cannot be switched off by the automatic voltage control. If the precipitator spark level is reached with no control of current to the precipitator, equipment damage can occur. The CLR provides a means of controlling and limiting the current flow to the precipitator until the conducting SCR switches off at the end of the half cycle.

Because of its critical role in maximizing electrostatic precipitator performance, it is vital that the CLR be properly sized. In the prior art, the CLR is sized at 30%-50% of the impedance of the transformer/rectifier (T/R) set. This calculation results in a rough estimate of the appropriate CLR size for a given application. The actual electrical efficiency is subjectively measured by viewing the shape and duration of the wave form of the secondary current with an oscilloscope and estimating the fractional conduction. The CLR is then adjusted by trial and error in an attempt to obtain the desired fractional conduction and, thereby, collection efficiency. Fractional conduction and other methods used to size CLRs in the prior art have been crude and inaccurate, allowing for operational inefficiency and equipment damage including blown fuses, equipment failure and inefficient performance from other components of the system.

The production output of many industries may be limited by the amount of pollution discharged. The government sets limits on the amount of pollution a facility may generate and discharge. In the event this limit is exceeded, a facility is subject to fines and temporary or permanent shut-down. Therefore, in terms of profitability, it is imperative that the electrostatic precipitator operate at its highest efficiency, and in the event of a malfunction, minimizing down time is a high priority.

The prior art requires time consuming calculations to determine initial operation settings for precipitator controls. In the event of a malfunction or fault, determining the exact problem and repairing or replacing the faulty component is time consuming and often requires disassembling of much of the precipitator or its controls. These limitations of the prior art all lead to operation inefficiency, equipment damage, inadequate performance and increased pollution emissions.

SUMMARY OF THE INVENTION

A long felt need in the air pollution control industry remains for improvements in the electrical control of electrostatic precipitators to alleviate the many operational and performance difficulties which have been encountered in the past. The primary goal of this invention is to fulfill this need.

Given the critical role the CLR plays in maximizing electrostatic precipitator performance, this invention provides an on-line means that accurately and dynamically measures fractional conduction for sizing the CLR, replacing the "trial and error" used in the prior art. Another accurate method of analysis is to measure the root mean square (RMS) value and the average value of the primary current, then divide RMS by average to obtain the form factor. The theoretical form factor in a purely resistive circuit is 1.11. It is well known in the art that at a low form factor of approximately 1.2, maximum power transfer and collection efficiency is achieved. Accordingly, an object of this invention is to calculate the form factor to provide a verifiable basis on which to measure electrical efficiency of the CLR and other electrical components. Since a form factor can be calculated using primary voltage as well as primary current values, it is also an object of this invention to give the user the option of using either value.

The electrical efficiency of the precipitator is also dependent upon the secondary current waveforms. It is well known in the art that the length of time the secondary current waveform pulse is present during the half cycle is determined by the correct matching and proper design of the precipitator components. For example; the T/R set, CLR and the size of the precipitator field must be matched for the precipitator to have maximum attainable collection efficiency for the application. Prior art requires point by point measurement of secondary current waveforms using an oscilloscope or similar device. Fractional conduction is then calculated from the waveforms shown on the oscilloscope.

The duration of the pulse relative to the maximum duration possible (8.33 milliseconds for 60 Hz. applications and 10 milliseconds for 50 Hz. applications) is known as the fractional conduction. A fractional conduction of 1 would be considered ideal. That is, the secondary current pulse would be present for the entire half cycle of 8.33 milliseconds. Fractional conductions of 0.86 normally yield full rated average currents on a precipitator load. Fractional conductions less than 0.86 result in less than full rated average currents on the precipitator which decreases the collection efficiency. Therefore, it is a further object of this invention to continuously measure the secondary current waveform and report the fractional conduction so that adjustments can be made, either manually or automatically, in system components to maintain maximum collection efficiency. This ability to automatically measure and report secondary current fractional conduction is not available under the prior art.

It is also an object of this invention to give the user the option of using either the form factor or the secondary waveform fractional conduction as a means to size the CLR.

Another object of this invention is to provide these values in such a way as to facilitate manual or automatic adjustments to the CLR.

A further object is to reduce start-up time by allowing programmable operating instructions that can be calculated and down loaded into the automatic voltage control. This will relieve the operator of initially having to calculate values and set the automatic voltage control, CLR, and other electrical components which will save time and reduce operator error.

Another object of the invention is to provide a calculator from which the impedance of the CLR is calculated.

Another important object is to minimize repair and troubleshooting time and expense by providing an automatic voltage control with the ability to diagnose fault conditions and suggest possible corrective measures.

Another object of this invention is to reduce repair time and costs by locating often damaged components in an easily accessible location. All over-voltage protection is positioned in a plug-in board. In the event that the automatic voltage control is damaged by over voltage, or modifications are needed for another application, this board can be removed and repaired without disassembling the entire automatic voltage control.

A further object of this invention is to provide a portable, stand-alone form factor and fractional conduction meter for use separate from an automatic voltage control. This meter will calculate form factor or fractional conduction for any electrostatic precipitator or similar equipment and immediately inform the operator how efficiently the equipment is performing.

Another object of this invention is to provide a novel method for calculating form factor and fractional conduction.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith, and in which like reference numerals are used to indicate like parts in the various views.

DETAILED DESCRIPTION OF THE INVENTION

This invention specifically contemplates determining the form factor and fractional conduction of an electrostatic precipitator to accurately measure whether the electrical components are sized properly. A device to measure the form factor and fractional conduction is described both as part of an automatic voltage control system and as a stand-alone meter. The invention calculates form factor and fractional conduction utilizing electrical characteristics such as voltage and current.

Figure 1:
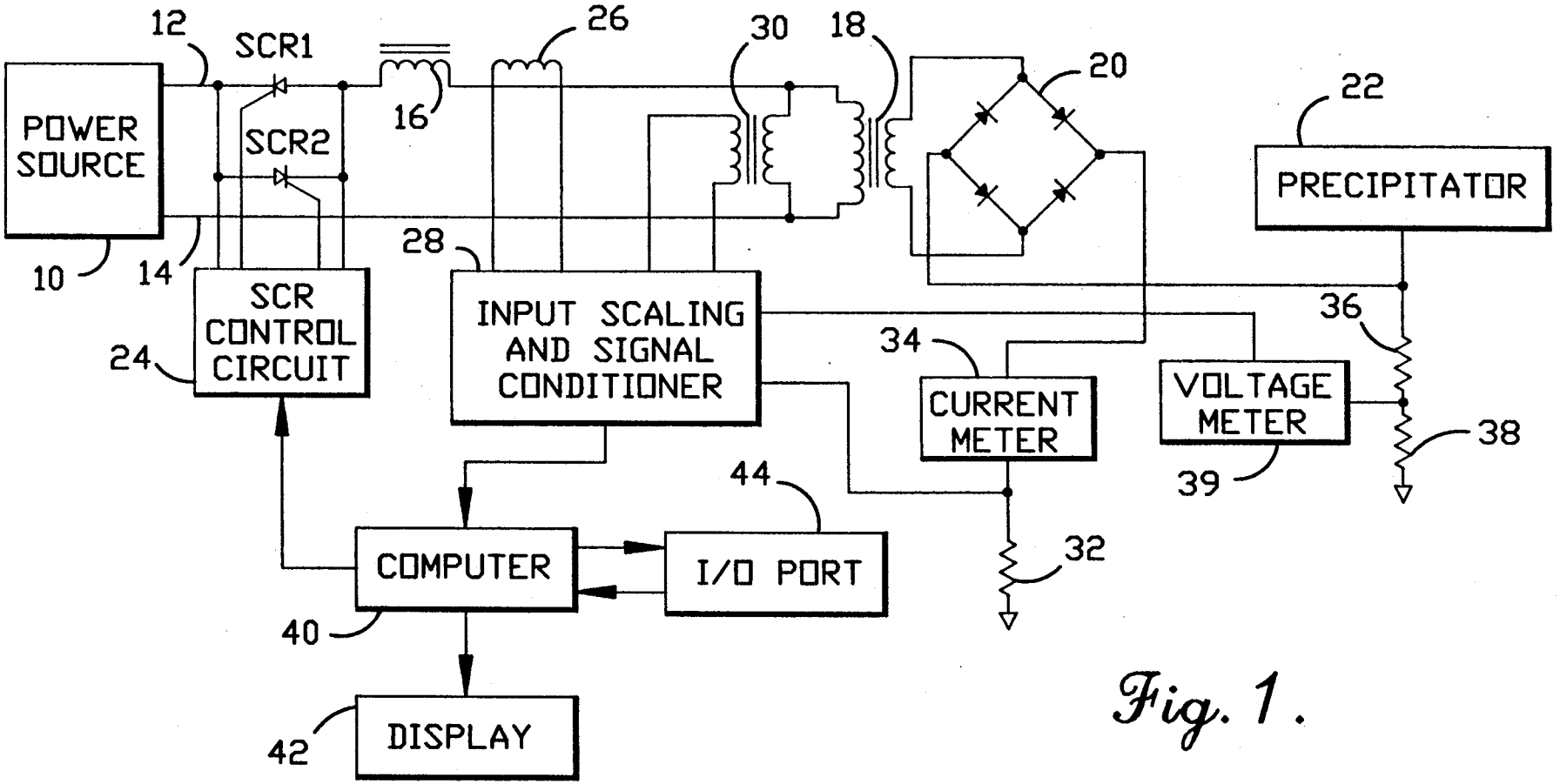
FIG. 1 is a block diagram of an electrical sizing circuit constructed in accordance with a preferred embodiment of the invention for an automatic voltage control circuitry.

Utilizing the form factor to properly size electrical components as part of an electrostatic precipitator's automatic voltage control is shown generally in FIG. 1 of the drawings. A power source 10, typically a 480-volt, single phase, AC power source, has two output terminals 12 and 14. Output terminal 12 connects serially to an inverse parallel SCR 1 and SCR 2, to a current limiting reactor 16, and to one side of the primary of a step-up transformer 18. Output terminal 14 connects to the other side of the primary of transformer 18. The secondary of transformer 18 is connected across a full-wave rectifier 20 which supplies power to precipitator 22. Transformer 18 and full-wave rectifier 20, in combination, is commonly referred to as the T/R set.

The positive output of rectifier 20 passes through a current meter 34 and resistor 32. The resistor 32 connects with an input scaling and signal conditioner 28. The negative output of rectifier 20 connects both to precipitator 22 as well as through a resistor 36 and a resistor 38 to ground. The voltage across resistor 38 is sensed by a voltage meter 39 and voltage meter 39 connects with input scaling and signal conditioner 28.

A current transformer 26 senses the input current and sends a signal to input scaling and signal conditioner 28. The primary of a potential transformer 30 is connected across the power input before transformer 18 and the secondary of transformer 30 is connected to the input scaling and signal conditioner 28.

The output of input scaling and signal conditioner 28 is connected to a computer 40 which is connected to an SCR control circuit 24. Computer 40 is also connected to a display 42 and bi-directionally connected to an input/output port 44. Display 42 may typically comprise an LM4457BG4C40LNY LCD display module such as manufactured by Densitron.

Figure 2:
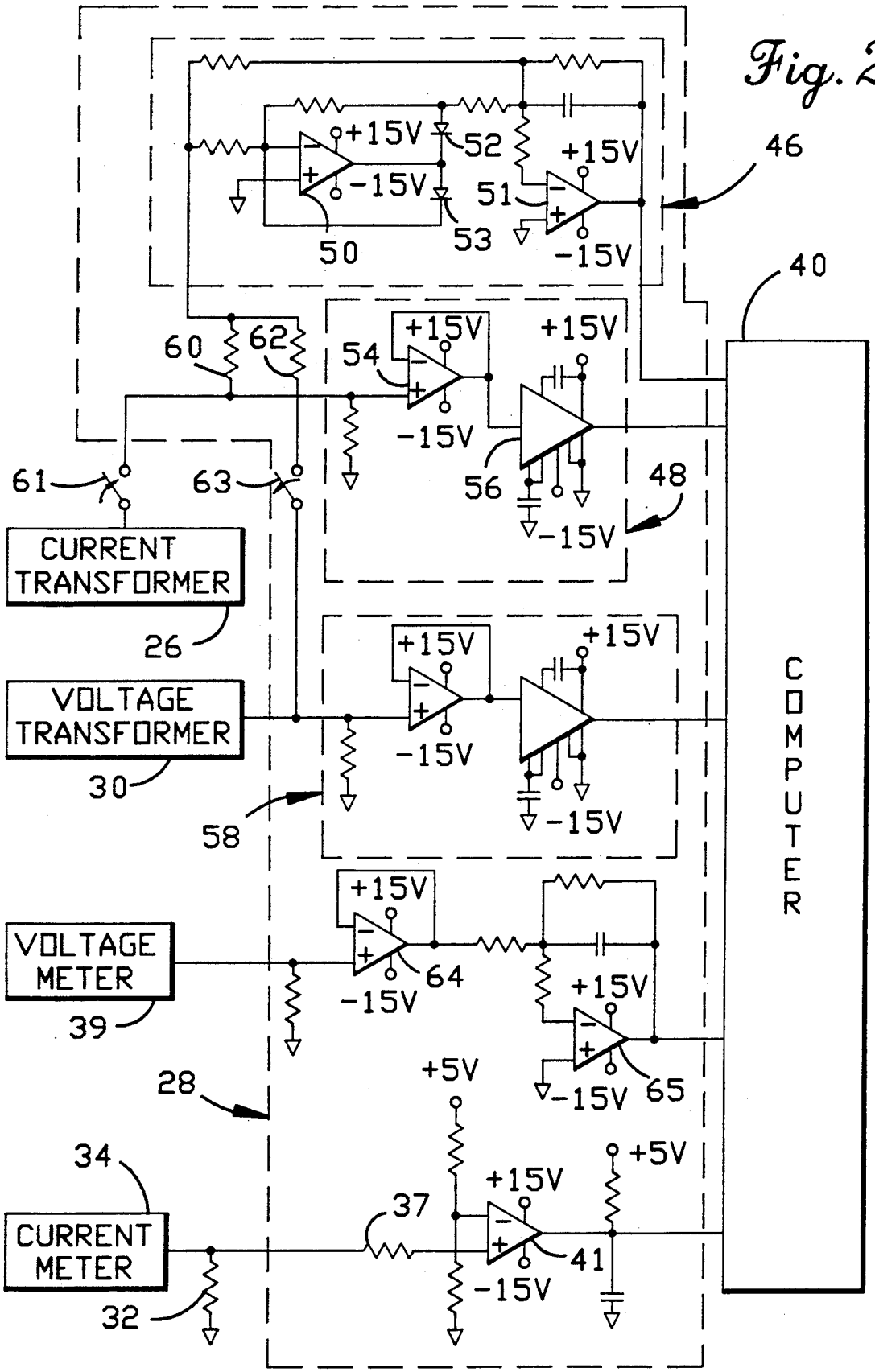
FIG. 2 is a block diagram illustrating in greater detail the input scaling and signal conditioning circuitry schematically shown in FIG. 1.

Input scaling and signal conditioner 28 is shown in detail in FIG. 2. Primary current is received from current transformer 26 and flows to two separate circuits, an averaging circuit 46 and an RMS circuit 48. The averaging circuit 46 has two operational amplifiers 50 and 51 and two diodes 52 and 53. The operational amplifiers 50 and 51 may typically comprise TL032CP chips as manufactured by Texas Instruments of Dallas, Tex.; and diodes 52 and 53 may typically comprise IN4148 diodes as also manufactured by Texas Instruments of Dallas, Tex. The output of averaging circuit 46 connects with computer 40. The RMS circuit 48 has an operational amplifier 54, typically the above mentioned TL032CP chip, and an RMS converter 56, typically an AD536AJD chip as manufactured by Analog Devices of Norwood, Mass. The output of RMS circuit 48 connects with computer 40.

Primary voltage is received from transformer 30 and flows to an RMS circuit 58. RMS circuit 58 is identical to RMS circuit 48 except that RMS circuit 58 receives primary voltage. The output of RMS circuit 58 connects with computer 40. The values of a resistor 60 and a resistor 62 control whether the averaging circuit 46 receives primary voltage or primary current.

Secondary voltage is received from voltage meter 39 and passes through two operational amplifiers 64 and 65 (both typically TL032CP chips as manufactured by Texas Instruments of Dallas, Texas) and enters computer 40. Secondary current present in precipitator 22 is received from current meter 34 and passes through external resistor 32. Resistor 32 converts the secondary current to a voltage which is directly proportional to secondary current. This voltage passes through resistor 37 and voltage comparator 41 on its route to computer 40. Voltage comparator 41 is a LM311N device as made by National Semiconductor Corporation of Santa Clara, Calif.

Figure 3:
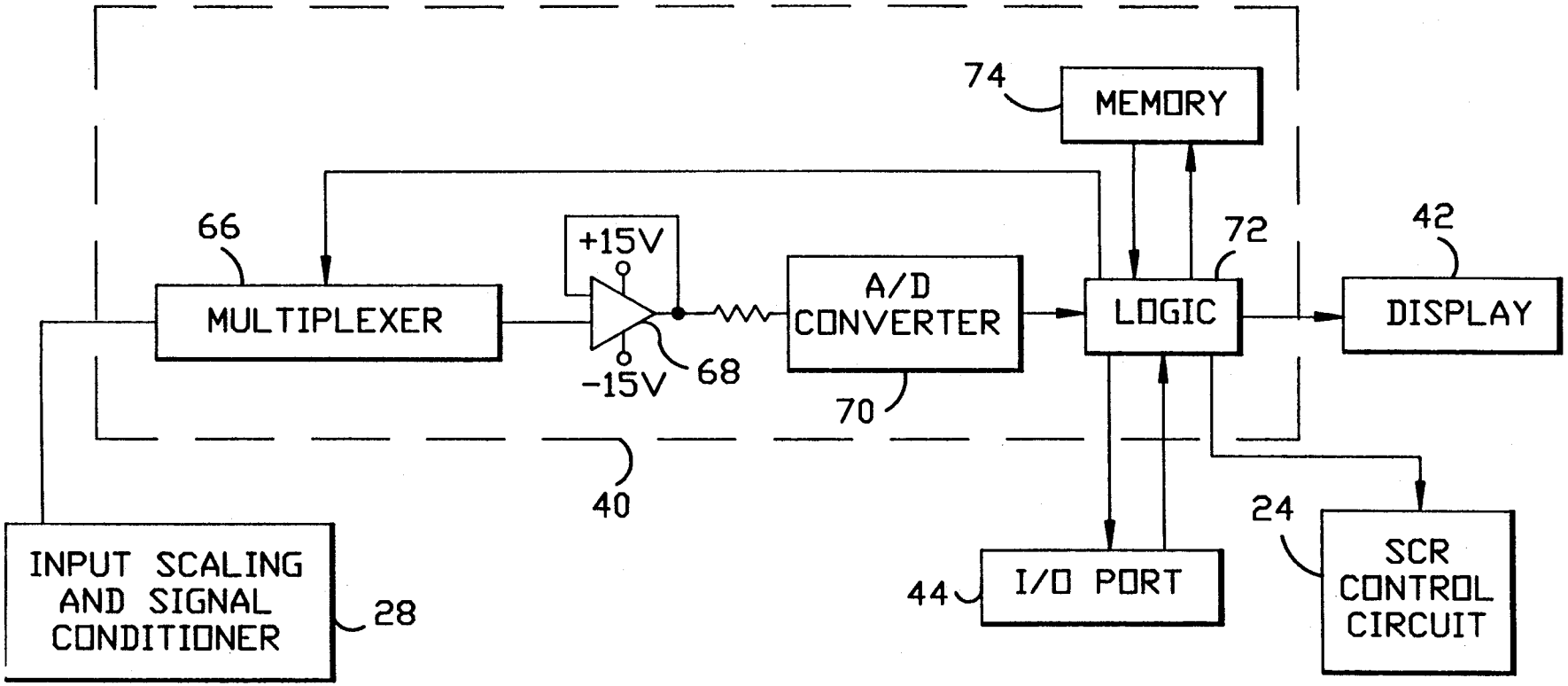
FIG. 3 is a block diagram illustrating in greater detail the components of the computer control schematically shown in FIG. 1.

Computer 40 is detailed in FIG. 3. A multiplexer 66 of computer 40 receives data from input scaling and signal conditioner 28. Multiplexer 66 may typically comprise an ADG508AKN chip such as manufactured by Analog Devices of Norwood, Mass. Multiplexer 66 is connected directly to a logic means 72 and connected in series with a buffer 68, an A/D converter 70 and logic means 72. The buffer 68 may typically be a Texas Instruments TL032CP operational amplifier chip and the A/D converter 70 may typically comprise an AD573JN chip such as manufactured by Analog Devices of Norwood, Mass. Logic means 72 is connected to SCR control circuit 24 and display 42, and is bi-directionally connected to input/output port 44 and bi-directionally connected to a memory means 74.

Figure 4:
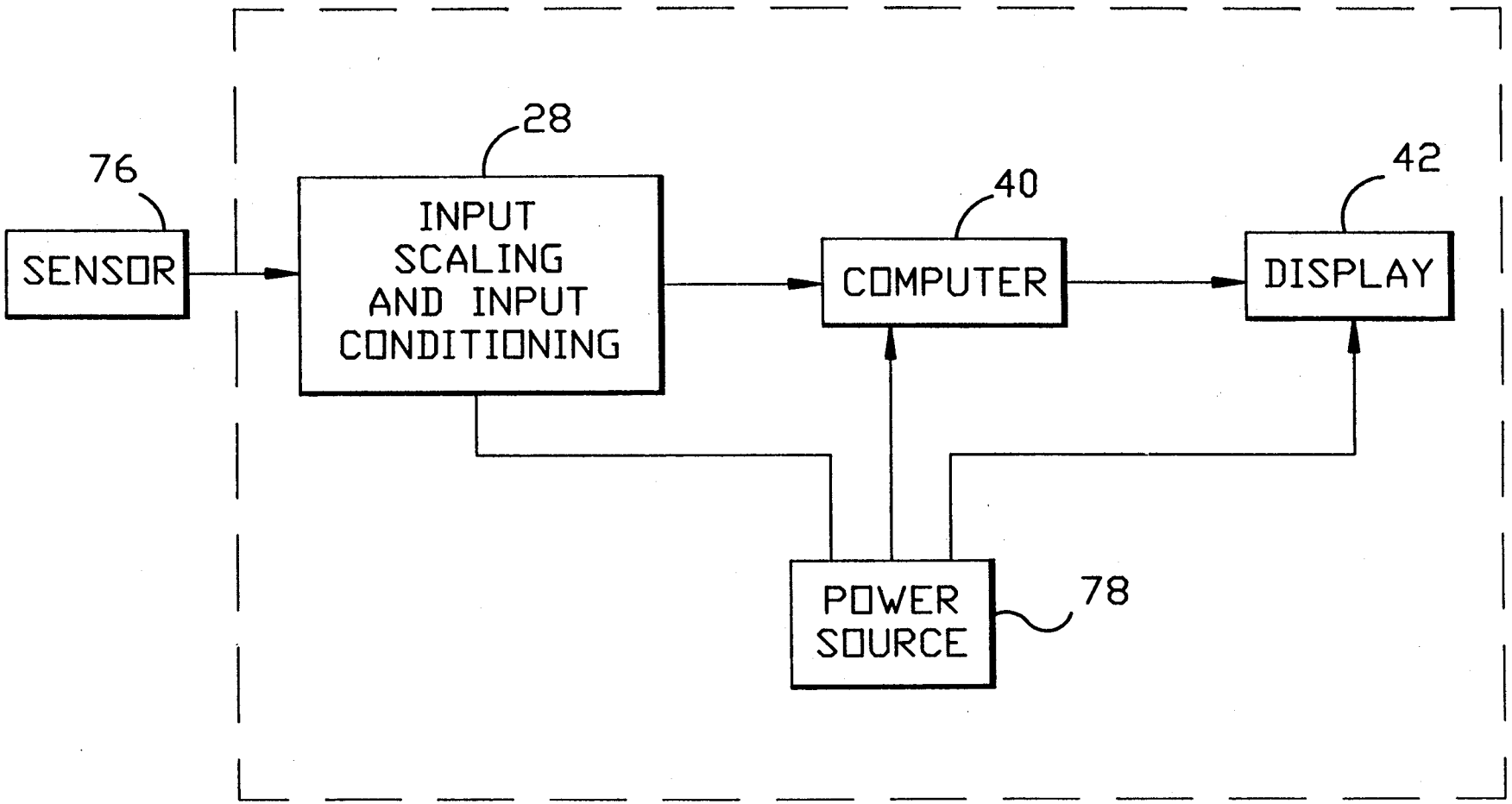
FIG. 4 is a block diagram of the form factor and fractional conduction meter of this invention illustrated as a stand-alone test instrument.

FIG. 4 is a block diagram of a form factor and fractional conduction meter as would be used as a standalone device. External sensor 76, which senses both primary and secondary electrical characteristics, is connected to the input scaling and signal conditioner 28 which connects with computer 40, and computer 40 connects to display 42. A power source 78 will power input scaling and signal conditioner 28, computer 40 and display 42. Power source 78 may consist of circuitry allowing the meter to plug into an external power source, or a battery or similar power supply. Sensor 76 may typically be a clamp as found on many models of current meters. It should be understood that sensor 76 may comprise a plurality of sensors. Sensor 76 is shown in block form for illustrative purposes.

In operation, the primary embodiment of this invention is to work in cooperation with an electrostatic precipitator automatic voltage control device. A representative example of an electrostatic precipitator automatic voltage control is shown in my earlier patent U.S. Pat. No. 4,605,424, issued Aug. 12, 1986 and entitled "Method and Apparatus for Controlling Power to an Electronic Precipitator", which is incorporated by reference herein. It should be recognized that, while these two inventions may share hardware, the problems addressed by each are distinct. The '424 patent controls voltage or power to the precipitator while this invention addresses the inefficiency of improperly sized components of an electrostatic precipitator.

Upon start up, input/output port 44 is utilized to communicate information to logic means 72 within computer 40. Communication may be accomplished through a built-in keyboard, portable lap-top computer, remote computer connected to the input/output port 44 directly or by modem, or by a similar means. Equipment size and power levels are communicated which allows initial calculations by logic means 72 to determine the proper setting of CLR 16 and other settings for other equipment. CLR 16 and other equipment may be set automatically, or the appropriate values may be sent to display 42 and the equipment set manually according to the previously calculated settings. The impedance of CLR 16 is calculated using calculator screens programmed into computer 40. The impedance is expressed as a percentage of the T/R set.

In addition to equipment size and power levels, the desired spark rate, SCR firing angle, fault conditions and rates of energization and all other information required by the automatic voltage control to supply power to the precipitator is communicated through input/output port 44 to logic means 72. This relieves the operator from having to manually set the equipment and helps to eliminate operator error. Information and calculated values required for future reference are sent from logic means 72 to memory 74.

The desired power level is sent from logic means 72, within computer 40, to SCR control circuit 24 where the power level is converted into an SCR firing angle. Power is applied to precipitator 22 in terms of SCR firing angle degrees. The sinusoidal electrical cycle consists of 360 degrees, and consists of a positive half cycle and a negative half cycle with respect to polarity. Each SCR can be fired anywhere from 0 degrees to 180 degrees in the electrical cycle, 0 degrees being full power and 180 degrees being 0 power. When an SCR is fired at 45 degrees, for example, it will conduct from 45 degrees to 180 degrees. Therefore, a difference in firing angles can be represented as a distance along the abscissa of the sine wave. Due to polarity reversal, the SCR stops conducting when the current passing through the SCR falls below a specified value for the device.

The normal operating state of SCR 1 and SCR 2 is 180 degrees which allows 0 power from power source 10 to pass through to precipitator 22. After SCR firing circuit 24 translates the power level into the appropriate angle, this angle is sent to SCR 1 and SCR 2 which begins allowing the appropriate power to pass from power source 10 down line to step-up transformer 18 and full-wave rectifier 20, and eventually to precipitator 22.

SCR 1 and SCR 2 inherently produce sharp rises in power when their respective firing angles dictate each SCR to energize. Thus, a primary object of CLR 16 is to filter and shape the signal leaving SCR 1 and SCR 2. Ideally, the shape of the secondary current filtered wave will be a broad, rectified sinusoidal waveform since the average value produces work. Such a waveform yields the best precipitator collection efficiency. Ideally, the peak and average values of the signal entering precipitator 22 will be very close.

In addition, maximum power transfer is attained when load impedance matches line impedance. CLR 16 is set so that its inductance matches total circuit impedance including the precipitator load. This is attained by measuring the form factor and sizing the equipment within the circuit to attain a form factor approaching 1.11.

Full-wave rectifier 20 converts the AC signal which passes through SCR 1 and SCR 2 into a pulsating DC signal. The positive output of full-wave rectifier 20 passes through current meter 34 and resistor 32 to ground. The negative output of full-wave rectifier 20 connects directly to precipitator 22 as well as through voltage dividing resistors 36 and 38 to ground. Voltage meter 39 is in series with metering resistor 36. Current meter 34 and voltage meter 39 are utilized to sense operating conditions when sparking occurs in precipitator 22 and to sense fault conditions. The data obtained from voltage meter 39 and current meter 34 are sent to input scaling and signal conditioner 28 and eventually to computer 40.

Current transformer 26 measures the primary current and transformer 30 provides the primary voltage with respect to transformer 18. These values are sent to input scaling and signal conditioner 28 where they are converted to a state which allows the form factor to be calculated.

The circuitry that is principal to this invention can be found in FIG. 2. Primary current and voltage along with secondary current and voltage each enter input scaling and signal conditioner 28. Primary current from current transformer 26 is introduced and flows to averaging circuit 46 and RMS circuit 48.

The first half of averaging circuit 46 is a precision rectifier consisting of an operational amplifier 50 and two diodes 52 and 53. This precision rectifier provides a DC output that is not offset by the voltage drop of the diodes. A second operational amplifier 51 provides an averaging circuit such that the input of the total circuit 46 is AC and the output of the total circuit 46 is DC, proportional to the average value of the AC wave. The output of averaging circuit 46 is routed to computer 40.

The primary current also enters an RMS circuit 48. Operational amplifier 54 provides an input buffer and signal conditioning while RMS converter 56 changes the AC input to its RMS value and this value is routed to computer 40. Computer 40 now has primary current in two forms: average and RMS.

Transformer 30 provides primary voltage to input scaling and signal conditioner 28. The primary voltage enters RMS circuit 58 which changes the AC input to its RMS value, in the same manner as RMS circuit 48, and this value is routed to computer 40.

Two resistors 60 and 62 are provided. When switch 61 is closed and switch 63 is open, resistor 60 conducts and the input scaling and signal conditioner 28 is configured to read the true RMS value and average value of the primary current for measuring form factor. By opening switch 61 and closing switch 63, resistor 62 conducts and the true RMS value and average value of the primary voltage can be used to calculate form factor. At all times the true RMS of both primary voltage and primary current are provided. Resistors 60 and 62 allow the option of calculating either the average of the primary current or the average of the primary voltage so that the form factor can be calculated using either current or voltage.

Secondary current and voltage signals from circuitry associated with current meter 34 and voltage meter 39 both enter input scaling and signal conditioner 28. Secondary voltage passes through operational amplifiers 64 and 65 which provides isolation and scaling before it is routed to computer 40. The secondary current signal from resistor 32 is routed through resistor 37 to voltage comparator 41. Voltage comparator 41 compares the voltage proportional to the secondary current in precipitator 22 with a reference voltage. Ideally, the reference voltage would be zero volts. Preferably, since voltage comparator 41 is not an ideal device, and therefore, has some input offset voltage, the reference voltage is set slightly above zero volts.

The output of voltage comparator 41 will become positive when the secondary current present in precipitator 22 is greater than zero. The output of voltage comparator 41 will become zero volts when the secondary current present in precipitator 22 is zero. Therefore, the output of voltage comparator 41 is a pulse width that is proportional to the length of time that the secondary current pulse is present in precipitator 22. This pulse width is routed to computer 40.

Computer 40 is pre-programmed with the maximum duration of pulse width possible for various line frequencies, or, alternatively, computer 40 could calculate the maximum pulse width possible for a desired frequency. For example, 8.33 milliseconds for 60 Hz. and 10 milliseconds for 50 Hz. Computer 40 measures the duration of the pulse width received from voltage comparator 41 and divides the measured pulse width by the maximum duration of pulse width possible for selected line frequency to obtain fractional conduction. It should be understood that although division is preferred, the actual and theoretical values may be compared in another manner to obtain fractional conduction data.

Fractional conduction data is stored in memory 74 of computer 40 so that is can be subsequently retrieved. The data can be displayed locally on display 42. In addition, it can be transmitted to a remote computer or other display or control device. If the fractional conduction is not sufficiently close to a preferred level, corrective equipment adjustments are made to yield a more efficient output. Fractional conductions of 0.86 normally yield full rated average currents on a precipitator load.

Multiplexer 66 accepts each of the output signals of input scaling and signal conditioner 28. Upon a signal from logic means 72, multiplexer 66 allows one of the input signals from input scaling and signal conditioner 28 to pass. This signal passes through buffer 68, is converted to a digital signal at the A/D converter 70 and enters logic means 72. When logic means 72 receives both an RMS value and an average value for either primary current or primary voltage, the RMS value is divided by the average value to obtain the form factor. It should be understood that the RMS and average values could be compared in another manner to obtain form factor data. The form factor value is then transmitted to display 42. Display 42 can be a liquid crystal display or similar digital display, a CRT displaying the value graphically, a printed numerical or graphical representation similar display. It is also understood that the form factor value can be transmitted to input/output port 44 and obtained remotely.

An operator evaluates whether this form factor value is sufficiently close to the 1.11 ideal value. If not, equipment sizing is manually adjusted. It is also understood that this can be a closed loop system where the CLR 16 is automatically adjusted upon the determination of a poor form factor.

To minimize repair and trouble shooting time in the event of unsatisfactory system performance, programmed help screens are employed. The programs diagnose fault conditions and display help screens on display 42. The help screens suggest possible corrective measures to the operator so that appropriate corrective adjustments may be made to increase system operating efficiency to a desired level.

All four inputs to multiplexer 66 are retrieved and analyzed by logic means 72 rapidly and continuously. When logic means 72 determines that current meter 34 experienced a sudden increase in current, a spark condition in precipitator 22 is analyzed. Upon determining a spark in precipitator 22, logic means 72 transmits information to SCR control circuit 24 to not energize again until the spark is extinguished. Since SCRs cannot shut off until the current passing through the SCR falls below a specified value for the device, up to an 8.33 millisecond delay, CLR 16 limits the current to precipitator 22 until the SCRs actually stop conducting. The time delay before re-energizing and the procedure for determining the appropriate firing angle with which to start energizing the SCRs is part of the automatic voltage control logic sequence and is detailed in the '424 patent.

The '424 patent also details how fault conditions are recognized and power shut down attained. But, in the '424 patent, determining what type of fault, the cause, specific location of the fault and potential solutions is left to the operator. The present invention incorporates diagnostic capabilities which greatly reduce down time. Therefore, computer 40 is fitted with non-volative memory 74, a device capable of retaining information when the power is removed. When the analog inputs to input scaling and signal conditioner 28 provides logic means 72 with a known fault condition, the information necessary to troubleshoot the precipitator 22, or its control circuits, and suggest corrective action can be retrieved from memory 74 and transmitted to display 42. For instance, if the primary and secondary current is found to be very high and the primary and secondary voltage found to be very low, this indicates a short condition. The memory device containing its pre-programmed information informs the computer 40 of a short condition. Computer 40 then analyzes the condition, retrieves the proper wording for a short and the corrective measures pre-programmed into memory 74, and routes them to display 42.

A major problem with the prior art has been that automatic voltage controls are connected to a precipitator that operates on a number of voltages. The line voltage is normally from 380–575 volts, 50–60 Hz. The secondary voltage is roughly 50,000 volts. The automatic voltage control runs on five (5) volts. The electrical supply is 120 volts. These diverse voltages create difficulties when isolating and protecting the circuitry from varying voltages.

For instance, a shorted primary to secondary transformer 18 can deliver damaging voltages. Therefore, a means must be available of protecting the automatic voltage control that can be easily and quickly repaired. This invention provides the automatic voltage control with a plug-in input circuit board where all the scaling and over-voltage protection is contained. When the automatic voltage control is wired into the system, it does not have to be removed to be repaired. This results in significant time and cost reductions.

The above mentioned form factor and fractional conduction measurement can be a part of the automatic voltage control that controls the SCRs or can be developed as a separate testing device to measure the efficiency and proper sizing of electrostatic precipitator components. FIG. 4 shows a form factor and fractional conduction meter as a stand-alone device. This device consists of sensor 76 which can typically be a clamp found on many present current transformers. Sensor 76 will sense the primary current of an electrostatic precipitator or similar device and provide this as an input to input scaling and signal conditioner 28. Input scaling and signal conditioner 28 will convert this current measurement to the average current and true RMS values. The true RMS value and average current value will be sent to computer 40 where the form factor calculations will be performed.

Additionally, sensor 76 detects the secondary current in the precipitator. Input scaling and signal conditioner 28 receives the secondary current signal and converts it to a pulse wave signal with a pulse width representing the duration of time secondary current is present in the precipitator. This converted signal is sent to computer 40 where the fractional conduction calculations are performed. Once the form factor and fractional conduction are determined, these values will be transmitted to display 42 for the operator to read and analyze the efficiency of the equipment being measured. Power source 78 will be available to drive each of these components. As a stand-alone portable device, this form factor and fractional conduction meter will be valuable to quickly and safely determine the present operating efficiency of electrostatic precipitators and similar equipment.

From the foregoing it will be seen that this invention is one well adapted to attain all end and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. An apparatus for measuring the form factor and fractional conduction of a given circuit having a transformer, said transformer having a primary side and a secondary side with primary and secondary electrical characteristics associated therewith, said apparatus comprising:

sensing means for sensing the primary waveform electrical characteristics of said circuit; detecting means for detecting the secondary waveform electrical characteristics of said circuit;

a conditioning circuit, connected to said sensing means and said detecting means, for conditioning said sensed primary electrical characteristics into values utilized in calculating said form factor value and conditioning said detected secondary electrical characteristics into values utilized in calculating said fractional conduction value, said conditioning circuit including means for changing said sensed primary electrical characteristics to their average value, means for changing said sensed primary electrical characteristics into their RMS value, and means for changing said detected secondary electrical characteristics to a signal representing the durational value of time a secondary electrical current is present in said circuit;

a computer connected to said conditioning circuit for calculating said from factor and said fractional conduction, said computer including logic means, said logic means including means of retrieving said average value from said conditioning circuit and means of retrieving said RMS value from said conditioning circuit, and means of comparing said RMS value with said average value to obtain the form factor value, and said logic means further including means for retrieving said time value signal and comparing said time value to a theroretical time value at a preselected frequency to obtain said fractional conduction value, wherein said form factor value and said fractional conduction value indicate circuit operating efficiency;

a source of electrical power connected to said conditioning circuit and said computer; and means for varying said electrical power whereby adjustments are made to said means for varying said electrical power to alter the primary waveform that is being sensed to substantially a desired waveform to increase circuit operating efficiency if said form factor departs from a desired level, and adjustments are made to said means for varying said electrical power to alter the secondary waveform that is being detected to substantially a desired waveform to increase circuit operating efficiency if said fractional conduction value departs from a desired level.

2. An apparatus as in claim 1 wherein said sensing means senses primary waveform electrical characteristics selected from the group consisting of voltage and current; and said detecting means detects secondary waveform electrical characteristics selected from the group consisting of voltage and current.

3. An apparatus as in claim 1 including a display means connected to said computer for visually displaying said form factor value and said fractional conduction value determined by said computer, an input/output port connected to said computer means, and said logic means further including means to transmit said form factor value and said fractional conduction value to said input/output port.

4. An apparatus as in claim 1, said computer including a multiplexer connected to said logic means for accepting and distinguishing said average signal, said RMS signal, and said time value signal, an analog to digital converter connected to said multiplexer and said logic means, said logic means including memory means for storing said form factor value and said fractional conduction value.

5. An apparatus as in claim 1 wherein said form factor value and said fractional conduction value indicate system operating efficiency and adjustments are made to said circuit thereby increasing system efficency if said form factor value or said fractional conduction value is not at a desired level.

6. An apparatus as in claim 1 wherein said logic means include means to divide said RMS value by said average value to obtain said form factor value and said logic means further include means to divide said durational time value by a theoretical value to obtain said fractional conduction.

7. The apparatus as set forth in claim 1 wherein said means for varying said electrical power comprises a current limiting reactor.

8. An apparatus for measuring the form factor and fractional conduction in cooperation with an automatic voltage control on an electrostatic precipitator comprising:

a source of electrical power;

a transformer/rectifier set connected between said power source and said precipitator;

means for varying said electrical power connected between said source of power and said transformer/rectifier set;

means for sensing the primary waveform electrical characteristics after said means for varying the electrical power and before said transformer/rectifier set;

means for detecting the secondary waveform electrical characteristics after said transformer/rectifier set and before said precipitator;

a conditioning circuit, connected to said means for sensing and said means for detecting to condition said sensed and said detected electrical characteristics for calculation of said form factor and said fractional conduction and determination of sparking in said precipitator; said conditioning circuit including means for changing said sensed characteristics to their average value, means for changing said sensed characteristics to their RMS value, and means for changing said detected characteristics to a signal representing the durational value of time a secondary electrical current is present in said precipitator;

computer means, connected to said conditioning circuit and said means for varying said electrical power, for calculating said form factor and said fractional conduction, determining when a spark occurs and controlling said means for varying said electrical power in response to the occurrence of a spark, so that power to said precipitator is varied;

said computer including logic means, said logic means including means of retrieving said RMS value from said conditioning circuit, means of retrieving said average value from said conditioning circuit, means of comparing said RMS value with said average value to obtain the form factor value, and means of retrieving said time value signal and comparing said time value with a theoretical value to obtain the fractional conduction value and determining the occurrence of a spark in said precipitator;

memory means for storing pre-determined rates of energization, spark rates, and calculations to determine proper firing angles;

means responsive to the occurrence of said spark for controlling said means for varying said electrical power to reduce power to said precipitator to 0; and means for adjusting said means for varying said electrical power according to pre-determined criteria stored in said memory and said calculated form factor value and said calculated fractional conduction value, whereby adjustments are made to said means for varying said electrical power to alter the primary waveform that is being sensed to substantially a desired waveform and adjustments are made to said means for varying said electrical power to alter the secondary waveform that is being detected to substantially a desired waveform which controls when and at what rate to begin allowing power to pass said means for varying said electrical power to said precipitator.

9. An apparatus as in claim 8, said computer further including a multiplexer connected to said logic means for accepting from said conditioning circuit and distinguishing said average signal, said RMS signal and said time value signal and an analog/digital converter connected to said multiplexer and said logic means; said logic means further including memory for storing said form factor value and said fractional conduction value.

10. The apparatus as set forth in claim 8 wherein said means for varying said electrical power comprises a current limiting reactor.

11. An apparatus as in claim 8 including a display means, connected to said computer, for visually displaying said form factor value and said fractional conduction value determined by said computer.

12. An apparatus as in claim 11 wherein said sensing means includes means to sense primary current and primary voltage, said conditioning circuit includes means to change the sensed voltage signal and the sensed current signal into their average and RMS value, and said logic means includes means for calculating the form factor using both primary current and primary voltage values.

13. An apparatus as in claim 12 wherein said detecting means includes means to detect secondary current, said conditioning circuit includes means to change said detected secondary current into a value representing the duration of time said secondary current is present in said precipitator.

14. An apparatus as in claim 13 to recognize circuit fault conditions and to de-energize said electrostatic precipitator upon detection of a fault condition, said apparatus further comprising:

means for storing pre-determined fault conditions in said memory;

means for storing potential causes and solutions to said fault conditions in said memory; and said logic means includes means of determining said fault conditions, and de-energizing said electrostatic precipitator upon determination of a fault condition; said logic means further includes means to analyze said fault conditions, means to retrieve the corrective measures pre-programmed into memory for the appropriate fault, and means to route said corrective measures to said display.

15. An apparatus as in claim 14 including input/output means connected to said computer, and wherein said logic means includes means to transmit said form factor value, said fractional conduction value, and other operating conditions to said input/output means, and means to receive from said input/output means initial operating conditions, fault conditions, initial electrical equipment sizing and other information necessary for the start-up and operation of said electrostatic precipitator.

16. An apparatus as in claim 15 including a removable plug-in circuit board on which is mounted all said means for scaling and over-voltage protection in order to facilitate removal and repair.

17. The method of measuring form factor and fractional conduction of a given circuit having a transformer, said transformer having a primary side and a secondary side with primary and secondary electrical characteristics associated therewith, said method comprising:

sensing the primary waveform electrical characteristics in said circuit;

detecting the secondary waveform electrical characteristics in said circuit;

conditioning said sensed primary electrical characteristics and said detected secondary electrical characteristics into values utilized in calculating said form factor and said fractional conduction;

calculating said form factor and said fractional conduction utilizing said conditioned electrical characteristics wherein said form factor and said fractional conduction indicate system operating efficiency;

adjusting the waveform that is being sensed to substantially a desired waveform to increase circuit operating efficiency if said form factor value departs from a desired level; and adjusting the waveform that is being detected to substantially a desired waveform to increase circuit operating efficiency if said fractional conduction value departs from a desired level.

18. The method as set forth in claim 17 including adjusting said circuit to increase system operating efficiency if said form factor value or said fractional conduction value falls below a desired level.

19. The method as set forth in claim 17 comprising sensing electrical waveform characteristics selected from the group consisting of primary voltage and primary current, and further comprising detecting electrical waveform characteristics selected from the group consisting of secondary voltage and secondary current.

20. The method as set forth in claim 19 wherein said conditioning further includes changing said sensed primary voltage signal and said sensed primary current signal into their average and RMS values, and changing said detected secondary current signal into a signal representing the durational value of time said secondary current is present in said circuit;

said calculating of form factor includes comparing said RMS value with said average value to obtain said form factor value using said voltage signal or said current signal; and said calculating of fractional conduction includes comparing said durational time value with a theoretical time value to obtain said fractional conduction value.

21. An apparatus for measuring the form factor of a given circuit, said apparatus comprising:

sensing means for sensing the current waveform in said circuit;

a conditioning circuit, connected to said sensing means, for conditioning said sensed waveform into values utilized in calculating said form factor; said conditioning circuit including means for changing said sensed waveform to its average value, and means for changing said sensed waveform to its RMS value;

a computer connected to said conditioning circuit for calculating said form factor value; said computer including logic means, said logic means including means of retrieving said RMS value and means of retrieving said average value and comparing said RMS value with said average value to obtain said form factor value;

a source of electrical power connected to said conditioning circuit and said computer; and means for varying said electrical power whereby said means for varying are adjusted based on said form factor value thereby altering the waveform that is being sensed to substantially a desired waveform to increase system operating efficiency.

22. An apparatus as in claim 21 including a display means, connected to said computer, for visually displaying said form factor value determined by said computer.

23. An apparatus as in claim 21, said computer further including a multiplexer connected to said logic means for accepting and distinguishing said average signal and said RMS signal, an analog to digital converter connected to said multiplexer, and memory means connected to said logic means for storing said form factor value and other information.

24. An apparatus as in claim 21 wherein said logic means include means to divide said RMS value by said average value to obtain said form factor value.

25. The apparatus as set forth in claim 21 wherein said means for varying said electrical power comprises a current limiting reactor.

26. An apparatus as in claim 21, wherein said sensing means further senses the voltage signal in said circuit.

27. An apparatus as in claim 26, wherein said sensing means senses both the current signal and the voltage signal in said circuit;

said conditioning circuit further including means to change the sensed voltage signal and the sensed current signal into their average value and RMS value; and said logic means further including means to divide said RMS value by said average value to obtain said form factor value using both said voltage signal and said current signal.

28. An apparatus as in claim 27, including an input-/output port connected to said computer means; and said logic means further including means to transmit said form factor value to said input/output port.

29. An apparatus for measuring the form factor in cooperation with an automatic voltage control on an electrostatic precipitator comprising:

a source of electrical power;

a transformer/rectifier set connected between said power source and said precipitator;

means for varying said electrical power connected between said source of power and said transformer rectifier set;

means for sensing the primary waveform electrical characteristics after said means for varying the electrical power and before said transformer/rectifier set;

a conditioning circuit, connected to said means for sensing to condition said sensed electrical characteristics for calculation of said form factor and determination of sparking in said precipitator; said conditioning circuit including means for changing said sensed characteristics to their average values, and means for changing said sensed characteristics to their RMS values;

computer means, connected to said conditioning circuit and said means for varying said electrical power, for calculating the form factor, determining when a spark occurs and controlling said means for varying said electrical power in response to the occurrence of a spark, so that the power to said precipitator is varied; said computer including logic means, said logic means including means of retrieving said average value from said conditioning circuit, means of retrieving said RMS value from said conditioning circuit, and means of comparing said RMS value with said average value to obtain the form factor value and determining the occurrence of a spark in said precipitator;

memory means for storing pre-determined rates of energization, spark rates, and calculations to determine proper firing angles;

means responsive to the occurrence of said spark for controlling said means for varying said electrical power to reduce power to said precipitator to 0; and means for automatically adjusting said means for varying said electrical power according to predetermined criteria stored in said memory and said form factor value whereby adjustments are made to said means for varying said electrical power to alter the primary waveform that is being sensed to substantially a desired waveform which controls when and at what rate to begin allowing power to pass said means for varying said electrical power to said precipitator.

30. An apparatus as in claim 29 wherein said logic means include means to divide said RMS value by said average value to obtain said form factor value.

31. The apparatus as set forth in claim 29 wherein said means for varying said electrical power comprises a current limiting reactor.

32. An apparatus as in claim 29, said computer including a multiplexer connected between said logic means and said conditioning circuit for accepting and distinguishing said average sensed signal and said RMS sensed signal, an analog/digital converter connected to said multiplexer to change said average signal and said RMS signals to digital signals, said logic means including memory for storing said form factor value.

33. An apparatus as in claim 32 including a display means, connected to said computer, for visually displaying said form factor value determined by said computer.

34. An apparatus as in claim 33, wherein said sensing means includes means to sense electrical characteristics selected from the group consisting of primary current and primary voltage, said conditioning circuit includes means to change the sensed voltage signal and the sensed current signal into their average value and RMS value, and said logic means includes means for calculating the form factor using both primary current and primary voltage values.

35. An apparatus as in claim 34 to recognize circuit fault conditions and to de-energize said electrostatic precipitator upon detection of a fault condition, said apparatus further comprising:

means for storing pre-determined fault conditions in said memory;

means for storing potential causes and solutions to said fault conditions in said memory; and said logic means includes means of determining said fault conditions, and de-energizing said electrostatic precipitator upon determination of a fault condition; said logic means further includes means to analyze said fault conditions, means to retrieve the corrective measures pre-programmed into memory for the appropriate fault, and means to route said corrective measures to said display.

36. An apparatus as in claim 35 including an input/output port connected to said computer, and wherein said logic means includes means to transmit said form factor value and other operating conditions to said input/output port, and means to receive from said input/output port initial operating conditions, fault conditions, initial electrical equipment sizing and other information necessary for the start-up and operation of said electrostatic precipitator.

37. An apparatus as in claim 36 including a removable plug-in circuit board on which is mounted all said means for scaling and over-voltage protection in order to facilitate removal and repair.

38. The method of measuring the form factor of a given circuit having a transformer, said transformer having a primary side and a secondary side with primary and secondary electrical characteristics associated therewith, said method comprising:

sensing the primary waveform electrical characteristics in said circuit;

conditioning said sensed electrical characteristics into values utilized in calculating said form factor;

calculating said form factor utilizing said conditioned electrical characteristics; and adjusting the waveform that is being sensed in said circuit to substantially a desired waveform if said form factor value departs from a desired level to increase system operating efficiency.

39. The method of claim 38 wherein said adjusting the waveform that is being sensed is accomplished by adjusting the inductive sizing of a current limiting reactor.

40. The method as set forth in claim 38 further comprising sensing electrical characteristics selected from the group consisting of voltage and current.

41. The method as set forth in claim 40 wherein said conditioning further includes changing said sensed electrical characteristic selected from the group consisting of voltage and current to their average and RMS values; and said calculating of said form factor includes dividing said RMS value by said average value to obtain said form factor value using said sensed electrical characteristic selected from the group consisting of voltage and current.

42. An apparatus for measuring the fractional conduction of a given circuit having a transformer, said transformer having a primary side and a secondary side with primary and secondary electrical characteristics associated therewith, said apparatus comprising:

sensing means for sensing the secondary waveform electrical characteristics in said circuit;

a conditioning circuit, connected to said sensing means for conditioning said electrical characteristics into a value utilized in calculating fractional conduction;

a computer connected to said conditioning circuit for calculating said fractional conduction, said computer including logic means, said logic means including means for retrieving said value utilized in calculating fractional conduction and comparing said value utilized in calculating fractional conduction to a theoretical value at a preselected frequency to obtain said fractional conduction value:

a source of electrical power connected to said conditioning circuit and said computer; and means to adjust the waveform that is being sensed in said circuit to substantially a desired waveform if said fractional conduction value departs from a desired level to increase system operating efficiency.

43. An apparatus as in claim 42 including a display means connected to said computer for visually displaying said fractional conduction value, an input/output port connected to said computer means, and said logic means further including means to transmit said fractional conduction value to said input/output port.

44. An apparatus as in claim 42 wherein said electrical characteristic is the secondary electrical current in said circuit;

said conditioning circuit includes comparing means for comparing said sensed secondary electrical current with a selected reference, whereby the output signal of said comparing means is a signal representing the durational value of time said secondary electrical current is present in said circuit; and said logic means comprises means for receiving said output signal of said comparing means and dividing said output signal by the maximum durational value of time it is possible, at a selected frequency, for secondary electrical current to be present in said circuit to obtain said fractional conduction value.

45. An apparatus as in claim 42 wherein said logic means further include memory means whereby said logic means store said fractional conduction value in said memory.

46. An apparatus as in claim 42 wherein said conditioning circuit further includes damping means for dissipating overvoltage thereby clamping said electrical characteristic to the operating range of said circuit to protect said circuit.

47. The apparatus of claim 42 wherein said means to adjust the waveform is a current limiting reactor whereby adjustments to said current limiting reactor produce alterations in the waveform that is being detected.

48. An apparatus for measuring fractional conduction in cooperation with an automatic voltage control on an electrostatic precipitator comprising:

a source of electrical power;

a transformer/rectifier set connected between said power source and said precipitator;

means for detecting the waveform electrical characteristics of said circuit after said transformer/rectifier set and before said precipitator;

a conditioning circuit, connected to said means for detecting to condition said detected electrical characteristics, for calculation of said fractional conduction, said conditioning circuit including means for comparing said detected electrical characteristics with a selected reference to obtain a value to be utilized in calculating said fractional conduction; and computer means, connected to said conditioning circuit for calculating said fractional conduction, said computer including logic means, said logic means including means for receiving said value to be utilized in calculating fractional conduction and comparing said value to be utilized with a theoretical value corresponding to a preselected frequency thereby obtaining said fractional conduction value, wherein said fractional conduction value indicates system operating efficiency and whereby said fractional conduction value is used as a basis to adjust the waveform that is being detected to substantially a desired waveform if said fractional conduction value departs from a desired level.

49. An apparatus as in claim 48 including means for varying said electrical power connected between said source of power and said transformer/rectifier set whereby said means for varying electrical power are adjusted to increase system operating efficiency if said fractional conduction value falls below a desired level.

50. An apparatus as in claim 48 including display means connected to said computer means for visually displaying said fractional conduction value, input/output means connected to said computer means whereby said input/output means receive said fractional conduction value and said input/output means are utilized to transmit information necessary for start-up and operation of said electrostatic precipitator, and said logic means include memory means for storing said fractional conduction value.

51. An apparatus as in claim 48 including means to dissipate over-voltage to protect the components of said circuit.

52. The apparatus of claim 48 wherein utilizing said fractional conduction value as a basis to adjust the waveform that is being detected includes making corrective alterations to a current limiting reactor connected between said power source and said transformer/rectifier set.

53. An apparatus as in claim 48 wherein said detecting means include means to detect secondary electrical characteristics including secondary electrical current.

54. An apparatus as in claim 53 wherein the output of said comparing means is a pulse signal, whereby the pulse width of said pulse signal is proportional to the duration of time said secondary current is present on said precipitator, and wherein said logic means receive said pulse signal and divide said pulse width by a theoretical pulse width for a preselected frequency thereby obtaining said fractional conduction value.

55. The method of measuring the fractional conduction of a given circuit having a transformer, said transformer having a primary side and a secondary side with primary and secondary electrical characteristics associated therewith, said method comprising:

sensing the secondary waveform electrical characteristics in said circuit;

conditioning said sensed electrical characteristics into values utilized in calculating said fractional conduction;

automatically calculating said fractional conduction utilizing said conditioned characteristics; and adjusting the waveform that is being sensed in said circuit to substantially a desired waveform to increase system operating efficiency if said fractional conduction value departs from a desired level.

56. The method as set forth in claim 55 including displaying said fractional conduction value on a visual display means.

57. The method of claim 55 wherein said adjusting the waveform that is being sensed is accomplished by adjusting the inductive sizing of a current limiting reactor.

58. The method as set forth in claim 55 further comprising sensing the secondary electrical current in said circuit.

59. The method as set forth in claim 58 wherein said conditioning includes comparing said sensed secondary electrical current with a reference thereby obtaining a value that represents the durational value of time said secondary electrical current is present in said circuit.

60. The method as set forth in claim 59 wherein said automatically calculating said fractional conduction includes comparing said durational time value with a theoretical time value thereby obtaining said fractional conduction value.

61. An apparatus for detecting fault conditions of an electrostatic precipitator comprising:

a source of electrical power;

a transformer/rectifier set connected between said power source and said precipitator;

means for varying said electrical power connected between said source of power and said transformer/rectifier set;

means for sensing the primary waveform electrical characteristics after said means for varying the electrical power and before said transformer/rectifier set;

means for detecting the secondary waveform electrical characteristics after said transformer/rectifier set and before said precipitator;

a conditioning circuit, connected to said means for sensing and said means for detecting to condition said sensed and detected electrical characteristics for determination of sparking in said precipitator; said conditioning circuit including means for scaling and detecting secondary electrical characteristics;

computer means, connected to said conditioning circuit and said means for varying said electrical power, for determining when a spark occurs and controlling said means for varying said electrical power in response to the occurrence of a spark, so that the power to said precipitator is varied; said computer including a multiplexer for accepting electrical characteristic signals from said conditioning circuit, an analog/digital converter connected to said multiplexer, and logic means with memory connected to said analog/digital converter and said multiplexer; said logic means including means of retrieving said detected secondary electrical characteristics and determining the occurrence of a spark in said precipitator;

memory means for storing pre-determined rates of energization, and spark rates;

means responsive to the occurrence of said spark for controlling said means for varying said electrical power to reduce power to said precipitator to 0; and means for adjusting said means for varying said electrical power according to pre-determined criteria stored in said memory and the waveform data retrieved which controls when and at what rate to begin allowing power to pass said means for varying said electrical power to said precipitator.

62. An apparatus as in claim 61 further including means to dissipate over-voltage to protect the components of the circuit.

63. The apparatus as set forth in claim 61 wherein said means for varying said electrical power comprises a current limiting reactor.

64. An apparatus as in claim 61 including a display means connected to said computer.

65. An apparatus as in claim 64 to recognize circuit fault conditions and to de-energize said electrostatic precipitator upon detection of a fault condition, said apparatus further comprising:

means for storing pre-determined fault conditions in said memory;

means for storing potential causes and solutions to said fault conditions in said memory; and said logic means includes means of determining said fault conditions, and de-energizing said electrostatic precipitator upon determination of a fault condition; said logic means further includes means to analyze said fault conditions, means to retrieve the corrective measures pre-programmed into memory for the appropriate fault, and means to route said corrective measures to said display.

66. An apparatus as in claim 61 wherein said means for scaling and detecting said secondary electrical characteristics include comparing means whereby said secondary electrical characteristics are compared to a reference to determine system operating efficiency.

67. An apparatus as in claim 66 wherein said secondary electrical characteristics include secondary current and said comparing means include pulse generating means whereby the generated pulse width is proportional to the duration of time said secondary current is present in said precipitator, and said computer means calculate fractional conduction whereby said computer measures said generated pulse width and divides said generated pulse width by said maximum pulse width for a preselected frequency.

68. An apparatus as in claim 67 wherein said computer means calculate fractional conduction whereby said computer measures said generated pulse width and divides said generated pulse width by said maximum pulse width for a preselected frequency.

69. The method of detecting and curing fault conditions of an electrostatic precipitator control system, said method comprising:

sensing the waveform electrical characteristics of said control system;

comparing said sensed waveform electrical characteristics with theoretical characteristics to determine system operating efficiency; and adjusting said system based on said comparisons to maintain said system operation at a desired efficiency by altering the waveform that is being sensed to substantially a desired waveform.

70. The method of claim 69 wherein said control system has a current limiting reactor and said altering the waveform that is being sensed is accomplished by adjusting the inductive sizing of said current limiting reactor.

71. The method of claim 69 wherein said control system includes a transformer, said transformer having a primary side and a secondary side with primary and secondary electrical characteristics associated therewith, and said sensing of said electrical characteristics further includes sensing both the primary and secondary electrical waveform characteristics selected from the group consisting of voltage and current, of said control system; and said determining of system operating efficiency is accomplished by changing said primary electrical characteristics into their average and RMS values and comparing said RMS value with said average value, and comparing said secondary electrical characteristics with a theoretical value at a preselected frequency thereby obtaining a plurality of measurements each individually indicating said system operating efficiency.

72. The method as set forth in claim 71 wherein said comparing of said RMS value with said average value includes dividing said RMS value by said average value to obtain a form factor value, and comparing said secondary electrical characteristics with a reference results in a fractional conduction value.

73. The method as set forth in claim 72 including displaying said form factor value and said fractional conduction value on a display means.

* * * * *